US007180023B2

(12) United States Patent
Seo

(10) Patent No.: US 7,180,023 B2
(45) Date of Patent: Feb. 20, 2007

(54) WASHING MACHINE

(75) Inventor: Jeong Ki Seo, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/332,304

(22) Filed: Jan. 17, 2006

(65) Prior Publication Data

US 2006/0180443 A1 Aug. 17, 2006

(30) Foreign Application Priority Data

Feb. 2, 2005 (KR) ..... 10-2005-0009650

(51) Int. Cl.
*H01H 13/00* (2006.01)

(52) U.S. Cl. ..... 200/329; 200/564; 200/11 R; 200/19.18

(58) Field of Classification Search ..... 200/329, 200/561–564, 293, 336, 316, 19.03, 19.18, 200/11 R
See application file for complete search history.

(56) References Cited

U.S. PATENT DOCUMENTS 4,579,018 A * 4/1986 Ohashi ..... 74/531
5,464,955 A * 11/1995 Cole ..... 200/317
5,550,343 A * 8/1996 Borger et al. ..... 200/569
6,288,351 B1 * 9/2001 Bruntz ..... 200/336
6,570,105 B1 * 5/2003 Sallam et al. ..... 200/4
7,038,156 B2 * 5/2006 Kim et al. ..... 200/564
2003/0170033 A1 * 9/2003 Peterson et al. ..... 398/172

FOREIGN PATENT DOCUMENTS

KR 10-2002-0020329 A 3/2002

* cited by examiner

*Primary Examiner*—K. Lee
(74) *Attorney, Agent, or Firm*—Sughrue Mion, PLLC

(57) ABSTRACT

A washing machine for reducing the movement of a dial knob. The washing machine comprises a control panel disposed on one side of a housing forming the external appearance of the washing machine, and provided with a circuit board installed therein for controlling the operation of the washing machine; a rotary switch installed on the circuit board and rotated for allowing a user to select functions of the washing machine; a dial knob passing through the control panel for transmitting external force to the rotary switch; a rotary shaft for transmitting the force from the dial knob to the rotary switch; a shaft receiving hole, in which the rotary shaft is installed; and shaft support ribs interposed between the rotary shaft and the shaft receiving hole for reducing the movement of the dial knob in the radial direction.

8 Claims, 5 Drawing Sheets

WASHING MACHINE

CROSS-REFERENCE TO RELATED APPLICATION

This application claims priority from Korean Patent Application No. 2005-9650, filed Feb. 2, 2005, in the Korean Intellectual Property Office, the disclosure of which is incorporated herein by reference.

BACKGROUND OF THE INVENTION

1. Field of the Invention

The present invention relates to a washing machine and, more particularly, to a washing machine, in which the movement of a dial knob is reduced.

2. Description of the Related Art

Generally, a washing machine is an apparatus, which washes laundry by repeating washing and rinsing operations. The washing machine performs the washing of the laundry by lifting and dropping the laundry, or using friction between the laundry.

A washing machine, which is disclosed in Korean Patent Laid-open Publication No. 10-2002-0020329, comprises a control panel, which is installed on the upper portion of the front surface of a housing forming the external appearance of the washing machine, and is provided with a dial knob and various operation buttons for allowing a user to select washing machine functions to operate the washing machine, and a circuit board installed in the control panel for controlling internal devices of the washing machine so that an operation inputted through the dial knob and the operation buttons is performed.

A through-hole is formed through the control panel so that the dial knob passes through the through hole of the control panel and is installed on the circuit board, and an encoder, on which marks, such as characters, are printed so that the user may identify the functions selected through the dial knob, is installed in the through-hole.

A rotary switch rotated by the dial knob for selectively performing the functions of the washing machine, LEDs for generating light to improve the identification of the marks printed on the encoder, and an encoder bracket for protectively covering the LEDs and guiding the light generated from the LEDs to the encoder are installed on the circuit board.

A rotary shaft, which is connected to the rotary switch so as to rotate the rotary switch together with the rotation of the dial knob, is installed on the center of the dial knob, and a shaft receiving hole for allowing the rotary shaft of the dial knob to pass through the encoder bracket and to be connected to the rotary switch is installed on the encoder bracket.

In the above washing machine, in order to smoothly rotate the dial knob, the outer cylindrical surface of the rotary shaft and the inner cylindrical surface of the shaft receiving hole must be spaced from each other by a designated interval.

When the interval between the outer cylindrical surface of the rotary shaft and the inner cylindrical surface of the shaft receiving hole is broad, the dial knob moves in the radial direction through the interval, and it is difficult to provide the reliance on stability of the washing machine product. On the other hand, when the interval between the outer cylindrical surface of the rotary shaft and the inner cylindrical surface of the shaft receiving hole is narrow, the outer cylindrical surface of the rotary shaft easily rubs against the inner cylindrical surface of the shaft receiving hole, and the dial knob may not be smoothly rotated.

SUMMARY OF THE INVENTION

Therefore, one aspect of the invention is to provide a washing machine, which performs smooth rotation of a dial knob and reduces the movement of the dial knob in the radial direction.

In accordance with one aspect, the present invention provides a washing machine comprising: a control panel disposed on one side of a housing forming the external appearance of the washing machine, and provided with a circuit board installed therein for controlling the operation of the washing machine; a rotary switch installed on the circuit board and rotated for allowing a user to select functions of the washing machine; a dial knob passing through the control panel for transmitting external force to the rotary switch; a rotary shaft for transmitting the force from the dial knob to the rotary switch; a shaft receiving hole, in which the rotary shaft is installed; and shaft support ribs interposed between the rotary shaft and the shaft receiving hole for reducing the movement of the dial knob in the radial direction.

An encoder bracket for protectively covering LEDs installed on the circuit board may be installed on the circuit board, and the shaft receiving hole may be formed through the encoder bracket.

The shaft support ribs may be extended from the outer cylindrical surface of the rotary shaft in the centrifugal direction, and be separated from each other by the same interval.

The shaft support ribs may be extended from the inner cylindrical surface of the shaft receiving hole in the centripetal direction, and be separated from each other by the same interval.

In accordance with another aspect, the present invention provides a washing machine, which has a control panel disposed on one side of a housing forming the external appearance of the washing machine, and provided with a circuit board installed therein for controlling the operation of the washing machine, a rotary switch installed on the circuit board and rotated for allowing a user to select functions of the washing machine, and a dial knob passing through the control panel for transmitting external force to the rotary switch, comprising: a ring-shaped support portion extended from the end of the outer surface of the dial knob in the centrifugal direction; and an upper support rib and lower support ribs located above and below the support portion for reducing the tilting of the dial knob.

The upper support rib may be extended downwardly from a region of the control panel adjacent to a through hole for passing the dial knob, and have a ring shape.

An encoder bracket for protectively covering LEDs installed on the circuit board may be installed on the circuit board, and the lower support ribs may be extended upwardly from the encoder bracket.

The lower support ribs may be disposed on the encoder bracket such that the lower support ribs are separated from each other by the same interval in the circumferential direction.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
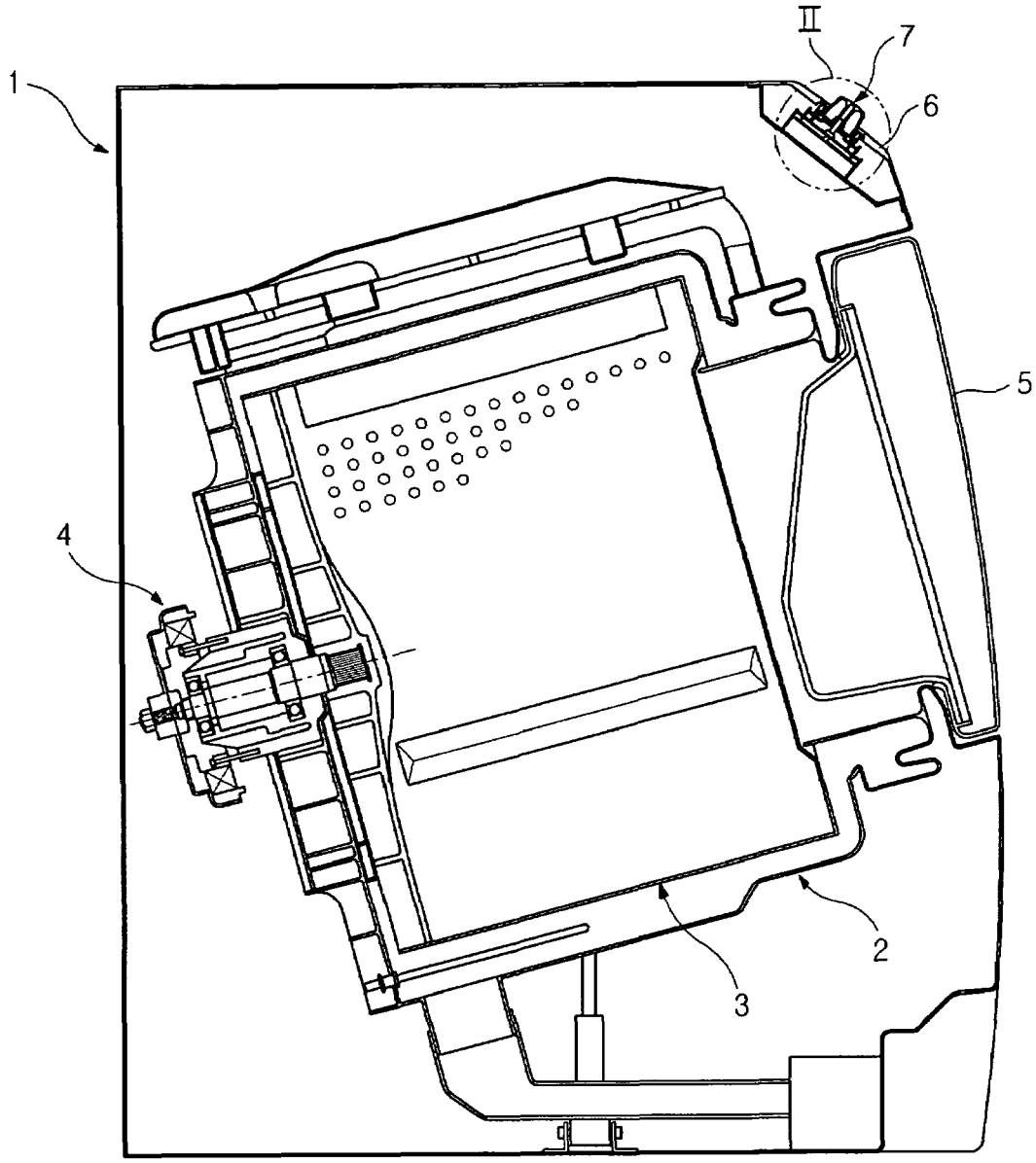
FIG. 1 is a longitudinal sectional view of a washing machine of the present invention.

DETAILED DESCRIPTION OF THE ILLUSTRATIVE, NON-LIMITING EMBODIMENTS OF THE INVENTION

Reference will now be made in detail to an exemplary embodiment of the present invention, an example of which is illustrated in the accompanying drawings, wherein like reference numerals refer to like elements throughout. The embodiment is described below to explain the present invention by referring to the annexed drawings.

In the exemplary embodiment, the present invention is applied to a drum washing machine.

A drum washing machine, to which the present invention is applied, as shown in FIG. 1, comprises a tub 2 suspended in a housing 1 forming the external appearance of the washing machine and for containing water, and a drum 3 rotatably installed in the tub 2 and rotated by a driving motor 4 and for containing laundry to be washed. The laundry contained in the drum 3 is lifted and dropped by the rotation of the drum 3, thereby being washed.

Front surfaces of the tub 2 and the drum 3 are opened so that the laundry is put into or taken out of the washing machine, and a door 5 is hinged to one side of the front surface of the housing 1 so as to open and close the tub 2 and the drum 3.

Figure 2:
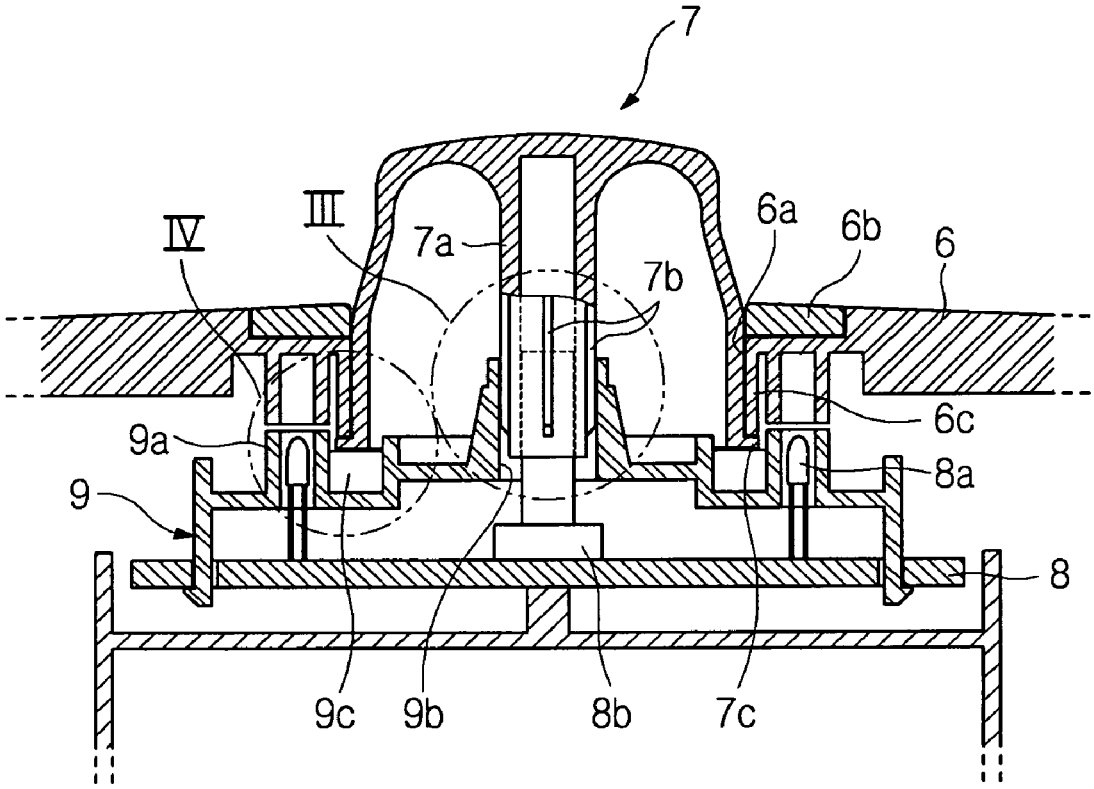
FIG. 2 is an enlarged view of the portion II of FIG. 1, illustrating the installation structure of a dial knob of the washing machine of the present invention.

A control panel 6 is installed on the upper portion of the front surface of the housing 1 so that a user selects functions of the drum washing machine through the control panel 6. As shown in FIG. 2, a plurality of operation buttons (not shown) and a dial knob 7 rotated for allowing the user to select functions of the drum washing machine are installed on the control panel 6, and a circuit board 8 for controlling internal devices of the drum washing machine is provided in the control panel 6 so that the function selected by the user is performed.

A through-hole 6*a* is formed through the control panel 6 so that the dial knob 7 passes through the through-hole 6*a* of the control panel 6 and is installed on the circuit board 8 disposed in the control panel 6. An encoder 6*b*, on which marks, such as characters, are printed so that the user can identify the function selected through the dial knob 7, is fixedly installed on a region of the control panel 6 adjacent to the through-hole 6*a*.

A plurality of LEDs 8*a* for improving the identification of the marks printed on the encoder 6*b* and a rotary switch 8*b* rotated by external force transmitted from the user through the dial knob 7 for selecting functions of the washing machine are installed on the circuit board 8. A rotary shaft 7*a* is integrally extended from the center of the dial knob 7, and is installed on the rotary switch 8*b* for rotating the rotary switch 8*b*.

An encoder bracket 9 having a cylindrical guide portion 9*a* for covering the LEDs 8*a* installed on the printed circuit 8 and guiding light generated from the LEDs 8*a* towards the encoder 6*b* is provided on the upper portion of the printed circuit 8. A shaft receiving hole 9*b* having a circular cross section is formed through the center of the encoder bracket 9 so that the rotary shaft 7*a* extended from the dial knob 7 passes through the shaft receiving hole 9*b* and is installed on the rotary switch 8*b*.

Figure 3:
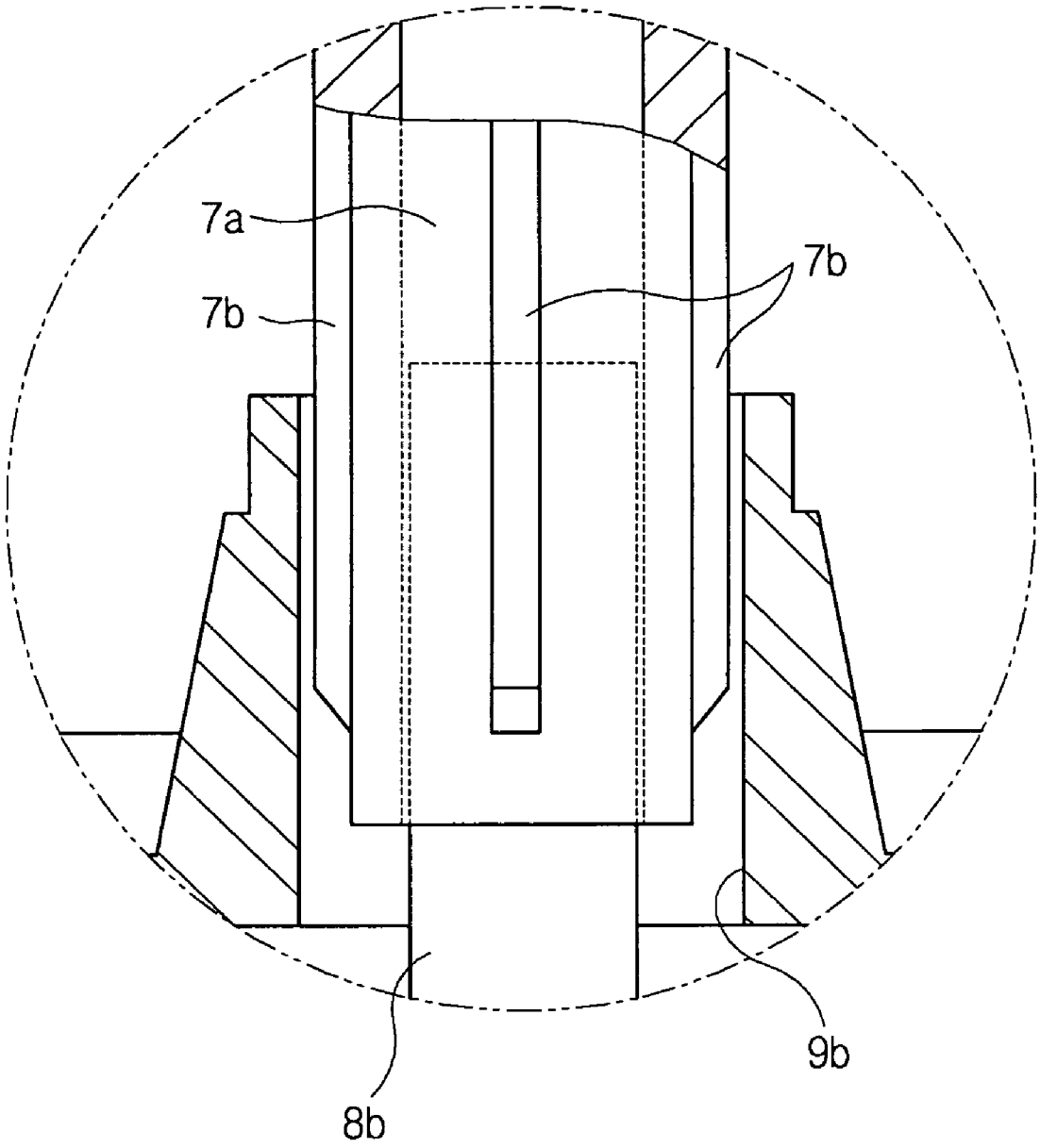
FIG. 3 is an enlarged view of the portion III of FIG. 2.

In the drum washing machine of the present invention, shaft support ribs 7*b*, as shown in FIG. 3, are interposed between the rotary shaft 7*a* and the shaft receiving hole 9*b* so as to prevent the dial knob 7 from moving in the radial direction more than a designated distance. In this embodiment, a plurality of the shaft support ribs 7*b* are extended from the outer surface of the rotary shaft 7*a* in the centrifugal direction, and are separated from each other by the same interval in the circumferential direction. Accordingly, when the dial knob 7 moves, the outer surface of the rotary shaft 7*a* is supported by contacting outer ends of the shaft support ribs 7*b* with the shaft receiving hole 9*b*, thereby reducing the movement of the dial knob 7 below a designated level.

Although the outer contact surface of the rotary shaft 7*a* is formed by the outer ends of the shaft support ribs 7*b*, the size of the contact surfaces of the shaft support ribs 7*b* is small as compared to the outer surface of the rotary shaft 7*a* without the shaft support ribs 7*b*. A small frictional force is generated between the contact surfaces at the outer ends of the shaft support ribs 7*b* and the shaft receiving hole 9*b*, and thus the rotation of the dial knob 7 is smoothly performed.

Figure 4:
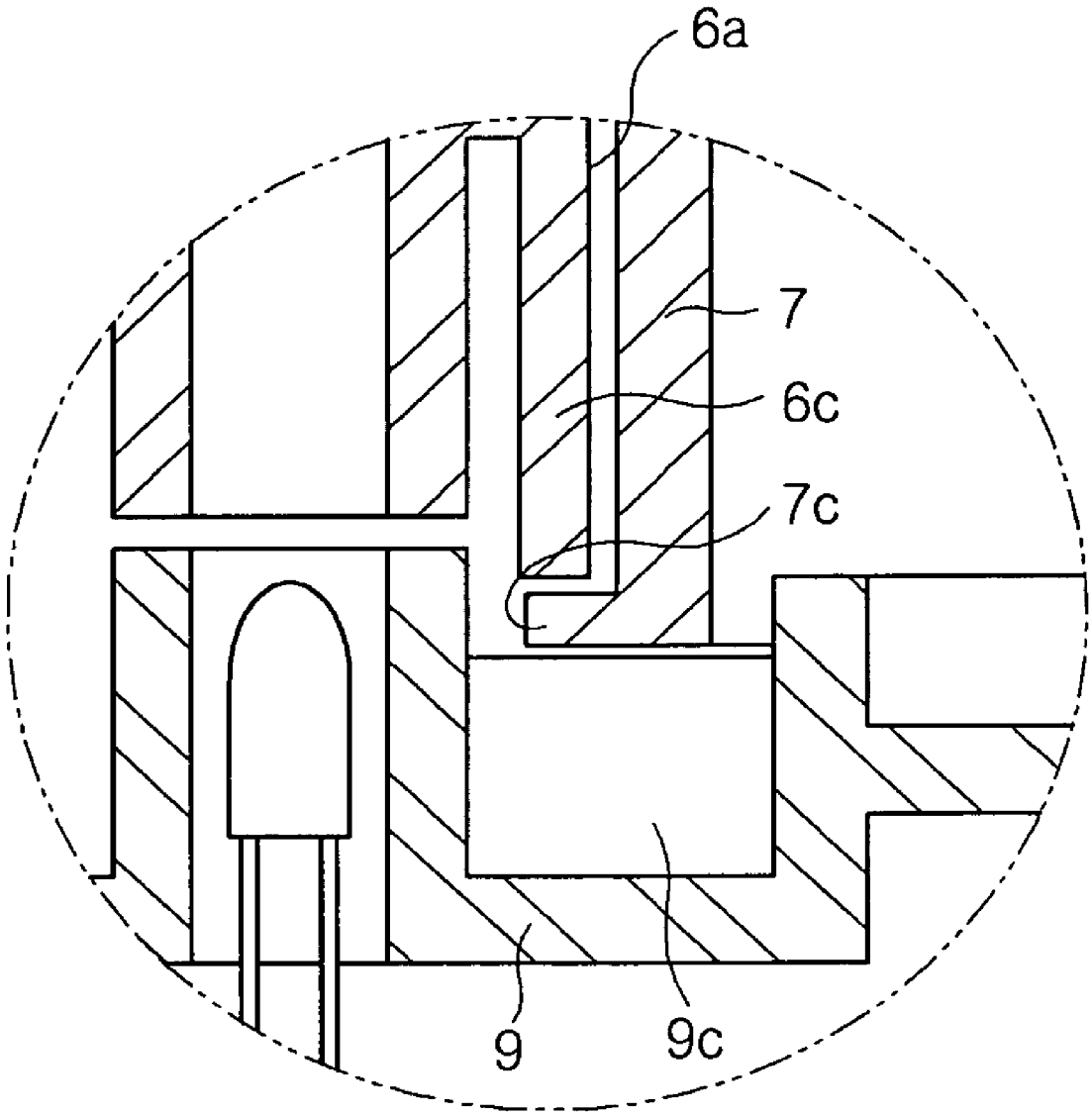
FIG. 4 is an enlarged view of the portion IV of FIG. 2.

In the drum washing machine of the present invention, an upper support rib 6*c* and lower support ribs 9*c* for supporting upper and lower surfaces of the end of the outer surface of the dial knob 7, as shown in FIG. 4, are installed so that the tilting of the dial knob 7 caused by the vertical movement of the end of the outer surface of the dial knob 7 is reduced. A ring-shaped support portion 7*c* is extended from the end of the dial knob 7 in the centrifugal direction, and is interposed between the upper support rib 6*c* and the lower support ribs 9*c*.

In this embodiment, the upper support rib 6*c* having a ring shape is extended downwardly from a region of the control panel 6 adjacent to the through-hole 6*a* so that the lower end of the upper support rib 6*c* supports the upper surface of the support portion 7*c* of the dial knob 7, and the lower support ribs 9*c* are extended upwardly from the encoder bracket 9. The lower support ribs 9*c* are separated from each other by the same interval in the circumferential direction centering on the shaft receiving hole 9*b*.

Accordingly, when a user applies force to the dial knob 7 so that the dial knob 7 is tilted, the upper surface of the support portion 7*c* of the dial knob 7 is supported by the upper support rib 6*c* and the lower surface of the support portion 7*c* of the dial knob 7 is supported by the lower support ribs 9*c*. Thereby, it is possible to prevent the dial knob 7 from being tilted above a designated level.

Figure 5:
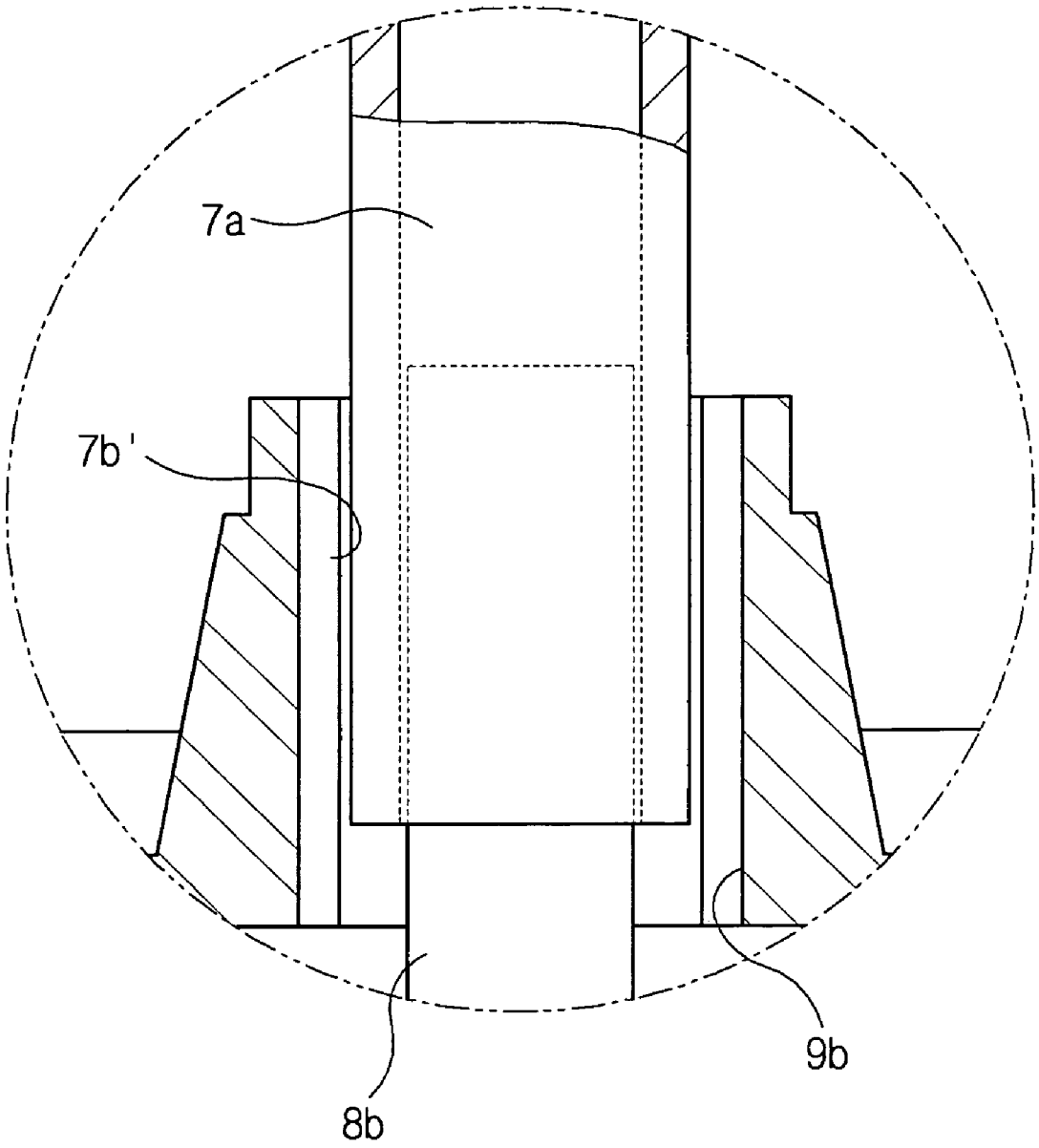
FIG. 5 is an enlarged view similar to FIG. 3 but showing another exemplary embodiment.

Although this embodiment describes the shaft support ribs 7*b* extended from the outer surface of the rotary shaft 7*a*, as shown in FIG. 5 the shaft support ribs 7*b* may be extended from the inner cylindrical surface of the shaft receiving hole 9*b* of the encoder bracket 9.

Further, although this embodiment describes the shaft receiving hole 9*b* formed through the encoder bracket 9, the shaft receiving hole 9*b* may be formed through the control panel 6.

As apparent from the above description, the present invention provides a washing machine, which comprises shaft support ribs interposed between a shaft receiving hole and a rotary shaft, thereby reducing the movement of a dial knob in the radial direction.

Further, since the washing machine of the present invention comprises an upper support rib and lower support ribs disposed above and below a support portion extended from the dial knob, the support portion is supported by the upper support rib and the lower support ribs when the dial knob is tilted by external force. Thereby, the washing machine reduces the tilting of the dial knob.

Although the exemplary embodiment of the invention has been shown and described, it would be appreciated by those skilled in the art that changes may be made in this embodiment without departing from the principles and spirit of the invention, the scope of which is defined in the claims and their equivalents.

What is claimed is:

1. A washing machine comprising:

a control panel disposed on one side of a housing forming the external appearance of the washing machine, and provided with a circuit board installed therein for controlling the operation of the washing machine;

a rotary switch installed on the circuit board and rotated for allowing a user to select functions of the washing machine;

a dial knob passing through the control panel for transmitting external force to the rotary switch;

a rotary shaft for transmitting the force from the dial knob to the rotary switch;

a shaft receiving hole, in which the rotary shaft is installed; and shaft support ribs interposed between the rotary shaft and the shaft receiving hole and operative to reduce the movement of the dial knob in the radial direction and to reduce a friction force between the shaft support ribs and a corresponding one of the shaft receiving hole and the rotary shaft.

2. The washing machine as set forth in claim 1, wherein an encoder bracket for protectively covering LEDs installed on the circuit board is installed on the circuit board, and the shaft receiving hole is formed through the encoder bracket.

3. The washing machine as set forth in claim 1, wherein the shaft support ribs are extended from the outer cylindrical surface of the rotary shaft in the centrifugal direction, and are separated from each other by the same interval, and wherein the shaft receiving hole presents a smooth inner cylindrical surface relative to the shaft support ribs.

4. The washing machine as set forth in claim 1, wherein the shaft support ribs are extended from the inner cylindrical surface of the shaft receiving hole in the centripetal direction, and are separated from each other by the same interval, and wherein the rotary shaft presents a smooth outer cylindrical surface relative to the shaft support ribs.

5. A washing machine, which has a control panel disposed on one side of a housing forming the external appearance of the washing machine and provided with a circuit board installed therein for controlling the operation of the washing machine, a rotary switch installed on the circuit board and rotated for allowing a user to select functions of the washing machine, and a dial knob passing through the control panel for transmitting external force to the rotary switch, comprising:

a ring-shaped support portion extended from the end of an outer surface of the dial knob in the centrifugal direction; and an upper support rib and lower support ribs located above and below the support portion for reducing the tilting of the dial knob.

6. The washing machine as set forth in claim 5, wherein the upper support rib is extended downwardly from a region of the control panel adjacent to a through-hole for passing the dial knob and has a ring shape.

7. The washing machine as set forth in claim 5, wherein an encoder bracket for protectively covering LEDs installed on the circuit board is installed on the circuit board, and the lower support ribs are extended upwardly from the encoder bracket.

8. The washing machine as set forth in claim 7, wherein the lower support ribs are disposed on the encoder bracket such that the lower support ribs are separated from each other by the same interval in the circumferential direction.

* * * * *